US011781277B1

(12) United States Patent
Lee

(10) Patent No.: US 11,781,277 B1
(45) Date of Patent: Oct. 10, 2023

(54) DAM WITH AUXILIARY DAM AND UNDERGROUND WATER PATH

(71) Applicant: Myeong Ho Lee, Cheonan-si (KR)

(72) Inventor: Myeong Ho Lee, Cheonan-si (KR)

(73) Assignee: Myeong Ho Lee, Cheonan-si (KR)

( * ) Notice: Subject to any disclaimer, the term of this patent is extended or adjusted under 35 U.S.C. 154(b) by 0 days.

(21) Appl. No.: 18/324,363

(22) Filed: May 26, 2023

(30) Foreign Application Priority Data

Sep. 8, 2022 (KR) ..... 10-2022-0113923

(51) Int. Cl.

| | |
|---|---|
| ***E02B 7/20*** | (2006.01) |
| ***E02B 7/36*** | (2006.01) |
| ***E02B 7/28*** | (2006.01) |
| ***E02B 8/04*** | (2006.01) |
| ***E02B 7/02*** | (2006.01) |

(52) U.S. Cl.
CPC ..... *E02B 7/205* (2013.01); *E02B 7/02* (2013.01); *E02B 7/28* (2013.01); *E02B 7/36* (2013.01); *E02B 8/045* (2013.01)

(58) Field of Classification Search
CPC ... E02B 7/205; E02B 7/02; E02B 7/28; E02B 7/36; E02B 8/045
See application file for complete search history.

(56) References Cited

U.S. PATENT DOCUMENTS 840,110 A * 1/1907 Coburn ..... E02B 9/00 405/78
5,161,913 A * 11/1992 Boylan ..... E02B 8/085 405/83
9,730,431 B2 * 8/2017 French ..... E02B 8/085

FOREIGN PATENT DOCUMENTS

| | | | |
|---|---|---|---|
| KR | 10-2006-0111892 | A | 10/2006 |
| KR | 10-2011-0038382 | A | 4/2011 |
| KR | 10-1267438 | B1 | 6/2013 |
| KR | 10-2014-0075590 | A | 6/2014 |
| KR | 10-1419520 | B1 | 7/2014 |
| KR | 20-2019-0001919 | U | 7/2019 |

* cited by examiner

*Primary Examiner* — Janine M Kreck
(74) *Attorney, Agent, or Firm* — Troutman Pepper Hamilton Sanders LLP (Rochester)

(57) ABSTRACT

A dam according to the present disclosure includes a main dam including a first reservoir, and at least one first discharge part configured to discharge water stored in the first reservoir, an auxiliary dam spaced apart from the main dam at a predetermined interval and including a second reservoir configured to store the water discharged from the main dam, and at least one second discharge part configured to discharge the water stored in the second reservoir, and an underground water path being provided separately at a lower side of a bottom surface of the river or stream under a lower side of the second reservoir, and including a third discharge part.

7 Claims, 3 Drawing Sheets

DAM WITH AUXILIARY DAM AND UNDERGROUND WATER PATH

CROSS-REFERENCE TO RELATED APPLICATION(S)

This application is based on and claims priority under 35 U.S.C. § 119 to Korean Patent Application No. 10-2022-0113923, filed on Sep. 8, 2022, in the Korean Intellectual Property Office, the disclosure of which is incorporated by reference herein in its entirety.

TECHNICAL FIELD

The present disclosure relates to a dam.

More specifically, the present disclosure relates to a dam having an auxiliary dam and an underground water path to prevent water from overflowing around a downstream side of the dam in the event of a flood due to heavy rainfall.

BACKGROUND

Water resources directly and indirectly affect human life in many ways. Lakes, rivers, and oceans not only provide an aesthetic support for human life, but they also provide a home for the many creatures that use them.

In addition, with the current development of industry, the water resources have been utilized as even more important resources, and many countries have put a lot of efforts into developing and conserving the water resources.

In Korea, where rainfall increases during limited periods, it is important to manage water resources properly because the damage caused by floods or droughts is relatively very large. To do this, dams are built across rivers and streams to store water by building structures using concrete and other materials. The dams serve to prevent damage caused by floods and to provide river water during droughts.

The dam is equipped with an outlet, and a sluice gate is installed in the outlet. The sluice gate blocks a flow of water to be discharged through the outlet or adjusts the amount of water to be discharged.

However, in the case of the dam in the related art, in the event of a flood due to heavy rainfall, the amount of water, which is discharged from an upstream side of the dam to a downstream side of the dam through the outlet of the dam, rapidly increases, and the water overflows around the downstream side of the dam, which causes a problem of flooding damage to surrounding farmland.

DOCUMENT OF RELATED ART

Patent Document (Patent Document 1) Korean Patent No. 10-1419520 (registered on Jul. 8, 2014)

SUMMARY

The present disclosure has been made in an effort to solve the above-mentioned problem in the related, and an object of the present disclosure is to provide a dam that discharges water, which is discharged from a main dam, selectively through an auxiliary dam or an underground water path, thereby preventing the water from overflowing around a downstream side of the dam in the event of a flood due to heavy rainfall.

To achieve the above-mentioned object, an exemplary embodiment of the present disclosure provides a dam, which is installed in a river or stream, the dam including: a main dam including a first reservoir, and at least one first discharge part configured to discharge water stored in the first reservoir; an auxiliary dam spaced apart from the main dam at a predetermined interval and including a second reservoir configured to store the water discharged from the main dam, and at least one second discharge part configured to discharge the water stored in the second reservoir; and an underground water path being provided separately at a lower side of a bottom surface of the river or stream under a lower side of the second reservoir, and including a third discharge part, wherein the water discharged from the main dam is controlled to be discharged through any one or both of the second discharge part and the third discharge part depending on a water level of the second reservoir.

The use of the dam according to the embodiment of the present disclosure achieves the following advantages.

First, in the event of a flood due to heavy rainfall, the water discharged from the main dam may be quickly discharged through the underground water path, thereby preventing the water from overflowing around the downstream side of the dam and preventing the farmland around the downstream side of the dam from being flooded.

Second, because the underground water path being provided at the lower side of the bottom surface of the river or stream under a lower side of the second reservoir, a horizontal width of a river or stream may be reduced, and farmland may be ensured and utilized to the extent of the reduced width of the river or stream.

DETAILED DESCRIPTION

Figure 1:
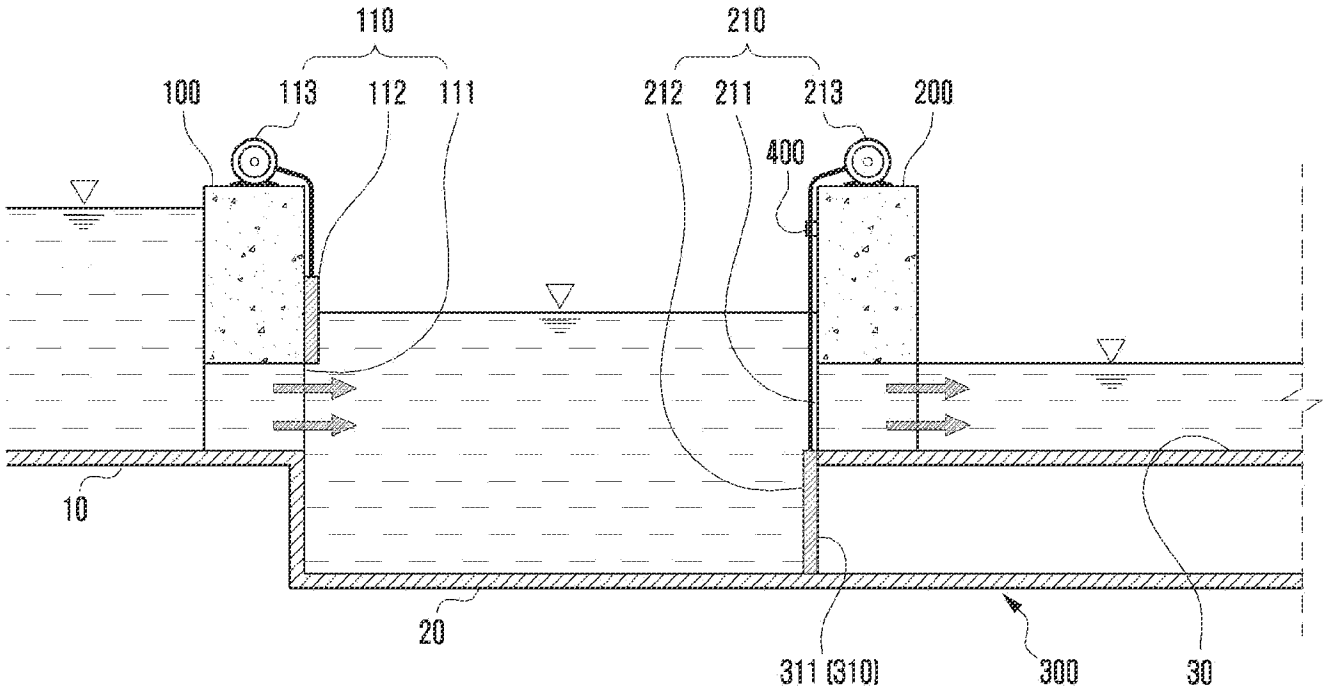
FIG. 1 is a view schematically illustrating a structure of a dam according to an embodiment of the present disclosure.

Hereinafter, exemplary embodiments according to the present disclosure will be described in detail with reference to the accompanying drawings. It should be noted that the same constituent elements will be designated by the same reference numerals in the accompanying drawings. Further, detailed descriptions of publicly-known functions and configurations, which may obscure the subject matter of the present disclosure, will be omitted.

Figure 2:
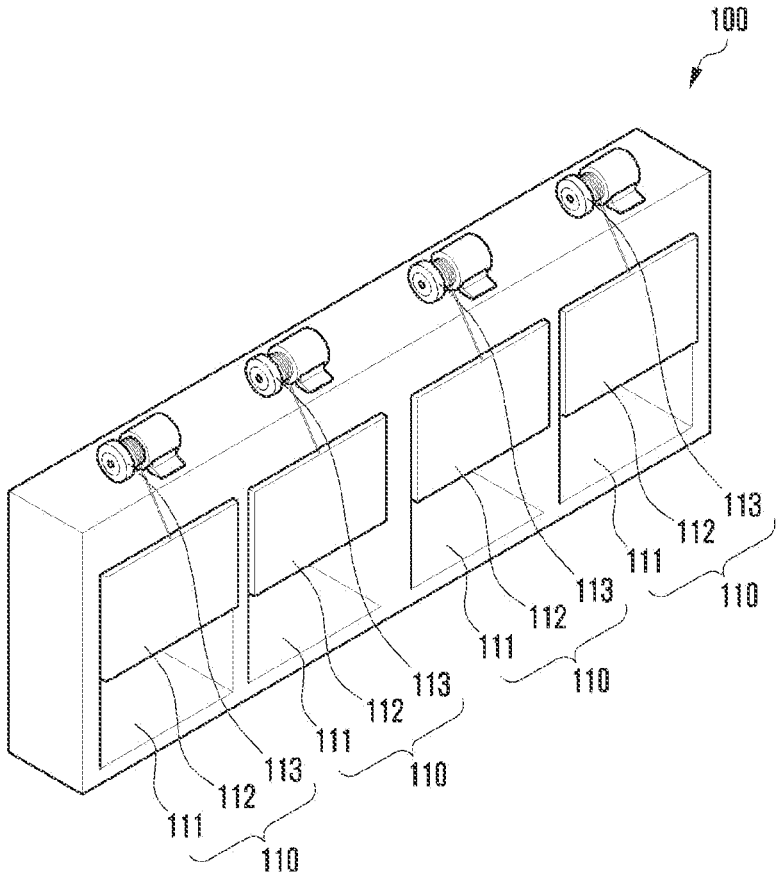
FIG. 2 is a perspective view schematically illustrating a structure of a main dam according to the embodiment of the present disclosure.
Figure 3:
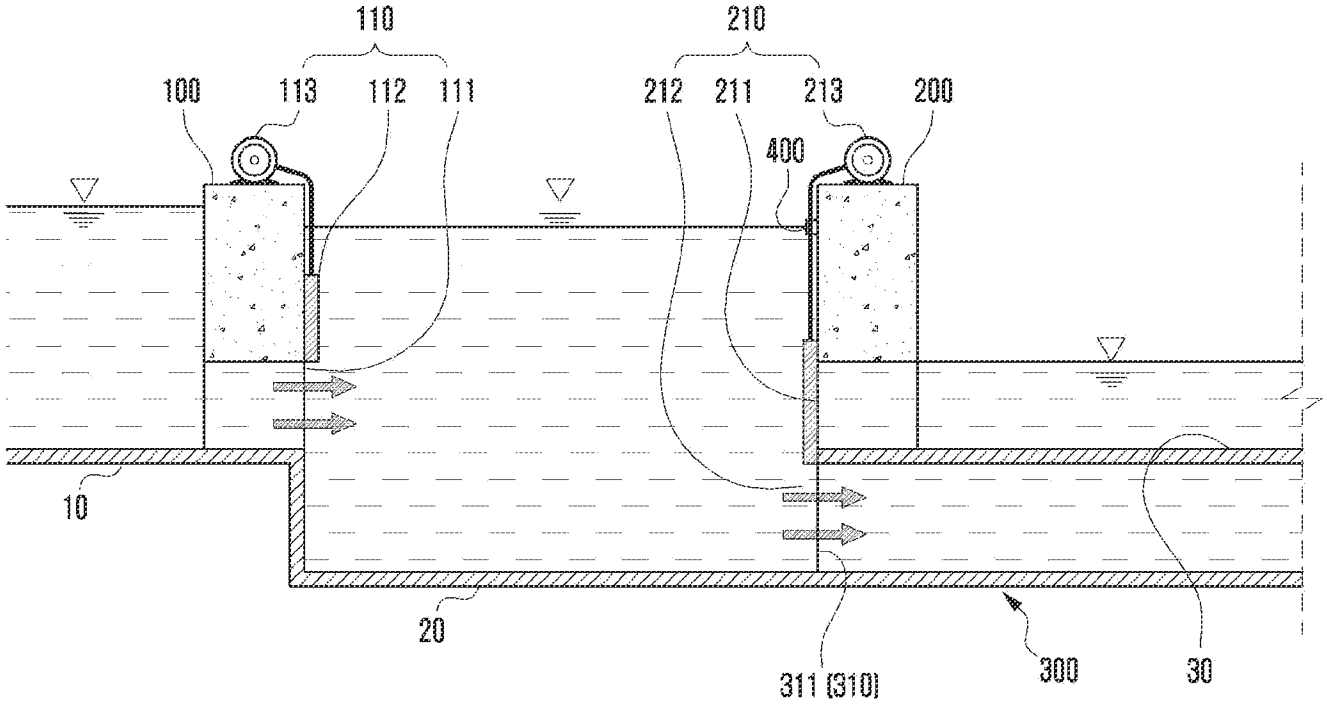
FIG. 3 is a view schematically illustrating a state in which water is discharged through an underground water path of the dam according to the embodiment of the present disclosure.

FIG. 1 is a view schematically illustrating a structure of a dam according to an embodiment of the present disclosure, FIG. 2 is a perspective view schematically illustrating a structure of a main dam according to the embodiment of the present disclosure, and FIG. 3 is a view schematically illustrating a state in which water is discharged through an underground water path of the dam according to the embodiment of the present disclosure.

With reference to FIGS. 1 to 3, a dam according to an embodiment of the present disclosure includes: a main dam 100 including a first reservoir 10, and at least one first discharge part 110 configured to discharge water stored in the first reservoir 10; an auxiliary dam 200 spaced apart from the main dam 100 at a predetermined interval and including a second reservoir 20 configured to store the water discharged from the main dam 100, and at least one second discharge part 210 configured to discharge the water stored in the second reservoir 20; and an underground water path 300 provided at a lower side of the second reservoir 20, disposed at a lower side of a bottom surface of a river or stream 30, and including a third discharge part 310. The water discharged from the main dam 100 is controlled to be discharged through any one or both of the second discharge part 210 and the third discharge part 310 depending on a water level of the second reservoir 20.

Hereinafter, a specific configuration and operation of the dam according to the embodiment of the present disclosure will be described in detail.

With reference back to FIG. 1, the dam according to the embodiment of the present disclosure may include the main dam 100, the auxiliary dam 200, and the underground water path 300.

For example, the main dam 100 may be installed across the river or stream. The main dam 100 may include the first reservoir 10 configured to store water, and the at least one first discharge part 110 configured to discharge the water stored in the first reservoir 10.

In this case, the first discharge part 110 may be embodied as a plurality of first discharge parts 110. In the present embodiment, as illustrated in FIG. 2, four first discharge parts 110 are provided on the main dam 100. However, it should be noted that the present disclosure is not limited thereto.

With reference to FIG. 2 together with FIG. 1, the plurality of first discharge parts 110 may each include a first discharge outlet 111, a first sluice gate 112, and a first drive part 113.

The first discharge outlet 111 may be provided in the main dam 100 and discharge the water, stored in the first reservoir 10, to the second reservoir 10. The first sluice gate 112 may be provided on the first discharge outlet 111. The first sluice gate 112 may adjust an amount of water to be discharged through the first discharge outlet 111 from the first reservoir 10.

The first drive part 113 may be installed to be connected to the first sluice gate 112 and open the first discharge outlet 111 by operating the first sluice gate 112. In the present embodiment, the first drive part 113 is implemented by a drive motor. However, it should be noted that the present disclosure is not limited thereto.

Meanwhile, some or all of the plurality of first discharge parts 110 may be opened depending on the amount of water stored in the first reservoir 10.

The auxiliary dam 200 according to the embodiment of the present disclosure may be disposed at a position spaced apart from the main dam 100 at a predetermined interval. The auxiliary dam 200 may include the second reservoir 20 configured to store water discharged from the main dam 100, and the at least one second discharge part 210 configured to discharge the water stored in the second reservoir 20. In this case, a bottom surface of the second reservoir 20 may be provided at the same height as a bottom surface of the underground water path 300.

The second discharge part 210 according to the embodiment of the present disclosure may be provided as a plurality of second discharge parts 210. Although not illustrated, in the present embodiment, four second discharge parts 210 are provided on the auxiliary dam 200 so as to correspond to the first discharge parts 110 of the main dam 100. However, it should be noted that the present disclosure is not limited thereto.

With reference to FIGS. 1 and 3, the plurality of second discharge parts 210 may each include a second discharge outlet 211, a second sluice gate 212, and a second drive part 213.

The second discharge outlet 211 may discharge water, stored in the second reservoir 20, to the river or stream 30. In this case, the second sluice gate 212 may be provided in the second discharge outlet 211. The second sluice gate 212 may adjust an amount of water to be discharged through the second discharge outlet 211.

The second drive part 213 may be installed to be connected to the second sluice gate 212 and open the second discharge outlet 211 by operating the second sluice gate 212. In the present embodiment, the second drive part 213 is implemented by a drive motor. However, it should be noted that the present disclosure is not limited thereto.

Meanwhile, some or all of the plurality of second discharge parts 210 may be opened depending on the amount of water stored in the second reservoir 20.

Meanwhile, in the event of a flood due to heavy rainfall, the amount of water stored in the first reservoir 10 increases, and the amount of water discharged from the main dam 100 increases. In this case, as the amount of water discharged from the auxiliary dam 200 increases, water in the river or stream 30 overflows, which may cause flooding damage to surrounding farmland.

The underground water path 300 according to the embodiment of the present disclosure is provided to solve the above-mentioned problems. The underground water path 300 may be provided at the lower side of the second reservoir 20 and disposed at the lower side of the river or stream 30. The underground water path 300 may have the third discharge part 310.

In this case, the third discharge part 310 may be embodied as a plurality of third discharge parts 310. Although not illustrated, in the present embodiment, four third discharge parts 310 are provided on the underground water path 300 so as to be equal in number to the first discharge parts 110 of the main dam 100. However, it should be noted that the present disclosure is not limited thereto.

With reference back to FIGS. 1 and 3, the plurality of third discharge parts 310 may each include a third discharge outlet 311.

The third discharge outlet 311 may be provided at a front end of the underground water path 300 and discharge water, which is discharged from the main dam 100, to the underground water path 300.

Meanwhile, the second sluice gate 212 may be movably provided between the second discharge outlet 211 and the third discharge outlet 311 and selectively open any one or both of the second discharge outlet 211 and the third discharge outlet 311 depending on a water level of the second reservoir 20.

For example, in case that the water level of the second reservoir 20 is equal to or higher than a preset water level as the amount of water discharged from the main dam 200 increases, the amount of water discharged through the auxiliary dam 200 increases, and the water may overflow around the river or stream 30.

In this case, the second sluice gate 212 opens the third discharge outlet 311 and closes the second discharge outlet 211 by the operation of the second drive part 213 so that the water discharged from the main dam 100 is discharged through the underground water path 300 without being discharged through the auxiliary dam 200.

That is, in case that the water level of the second reservoir 20 is equal to or higher than the preset water level, the second sluice gate 212 opens the third discharge outlet 311 of the underground water path 300 so that the water is discharged toward the underground water path 300, thereby preventing the water in the river or stream 30 from overflowing and causing flooding damage to the surrounding area.

The dam according to the embodiment of the present disclosure may further include a water level sensor 400 and a controller (not illustrated).

The water level sensor 400 may be provided on the auxiliary dam 200 and detect a water level of the second reservoir 20.

That is, when the water level sensor 400 detects the water level of the second reservoir 20, the controller determines that the water level of the second reservoir 20 is equal to or higher than the preset water level, such that the controller allows the second sluice gate to close the second discharge outlet 211 of the auxiliary dam 200 and opens the third discharge outlet 311 of the underground water path 300 so that the water discharged from the main dam 100 is discharged to the underground water path 300.

In this case, the controller may receive a signal detected by the water level sensor 400 and control the operation of the second drive part 213.

More specifically, when the water level sensor 400 detects the water level of the second reservoir 20, the controller controls the second drive part 213 to allow the second sluice gate 212 to close the second discharge outlet 211 to prevent the water from being discharged through the auxiliary dam 200, and the controller opens the third discharge outlet 311 to allow the water to be discharged through the underground water path 300.

Meanwhile, although not illustrated, on the basis of the water level of the second reservoir 20, the controller controls the second drive part 213 to allow the second sluice gate 212 to partially open the second discharge outlet 211 and partially open the third discharge outlet 311 (a state in which the second sluice gate is positioned between the second discharge outlet and the third outlet) so that the water may be discharged through a part of the second discharge outlet 211 and a part of the third discharge outlet 311.

Hereinafter, a process of operating the dam according to the embodiment of the present disclosure will be described.

First, with reference to FIG. 1, at ordinary times when there is no heavy rainfall, i.e., in case that the water level sensor 400 does not detect the water level of the second reservoir 20, the first drive part 113 of the main dam 100 operates to allow the first sluice gate 112 to open the first discharge outlet 111, and the second drive part 213 of the auxiliary dam 200 operates to allow the second sluice gate 212 to open the second discharge outlet 211 and close the third discharge outlet 311 of the underground water path 300. In this case, the water in the first reservoir 10 is discharged through the first discharge outlet 111 of the main dam 100, passes through the second reservoir 20, and is discharged to the river or stream 30 through the second discharge outlet 211 of the auxiliary dam 200.

Next, with reference to FIG. 2, in the event of a flood due to heavy rainfall, i.e., in case that the water level detection sensor detects the water level of the second reservoir 20, the first drive part 113 of the main dam 100 operates to allow the first sluice gate 112 to open the first discharge outlet 111, and the second drive part 213 of the auxiliary dam 200 operates to allow the second sluice gate 212 to close the second discharge outlet 211 and open the third discharge outlet 311 of the underground water path 300. In this case, the water in the first reservoir 10 is discharged through the first discharge outlet 111 of the main dam 100, passes through the second reservoir 20, and is discharged to the underground water path 300 through the third discharge outlet 311.

As described above, the dam according to the embodiment of the present disclosure may allow the water, which is discharged from the main dam, to be quickly discharged through the auxiliary dam or the underground water path in the event of a flood due to heavy rainfall, thereby preventing the water from flowing over the dam and maximally preventing farmland around the dam from being flooded.

In addition, because the underground water path is provided at the lower side of the bottom surface of the river or stream, a horizontal width of a river or stream may be reduced, and farmland may be ensured and utilized to the extent of the reduced width of the river or stream.

While the present disclosure has been described above with reference to the accompanying drawings and the exemplary embodiments, the protection scope of the present disclosure is not limited to the drawings and the exemplary embodiment, and any modification and alteration may be made without departing from the technical spirit of the present disclosure.

What is claimed is:

1. A dam, which is installed in a river or stream, the dam comprising:

a main dam including a first reservoir, and at least one first discharge part configured to discharge water stored in the first reservoir;

an auxiliary dam spaced apart from the main dam at a predetermined interval and including a second reservoir configured to store the water discharged from the main dam, and at least one second discharge part configured to discharge the water stored in the second reservoir; and an underground water path being provided separately at a lower side of a bottom surface of the river or stream under a lower side of the second reservoir, and including a third discharge part, wherein the water discharged from the main dam is controlled to be discharged through any one or both of the second discharge part and the third discharge part depending on a water level of the second reservoir.

2. The dam of claim 1, wherein the first discharge part is embodied as a plurality of first discharge parts, wherein each of the plurality of first discharge parts comprises:

a first discharge outlet provided in the main dam and configured to discharge the water stored in the first reservoir;

a first sluice gate provided on the first discharge outlet and configured to adjust an amount of water to be discharged through the first discharge outlet; and a first drive part installed to be connected to the first sluice gate and configured to perform an operation of opening or closing the first sluice gate, wherein the second discharge part is embodied as a plurality of second discharge parts, and wherein each of the plurality of second discharge parts comprises:

a second discharge outlet provided in the auxiliary dam and configured to discharge the water stored in the second reservoir to the bottom surface of the river or stream;

a second sluice gate provided on the second discharge outlet and configured to adjust an amount of water to be discharged through the second discharge outlet; and a second drive part installed to be connected to the second sluice gate and configured to perform an operation of opening or closing the second sluice gate.

3. The dam of claim 2, wherein the third discharge part is embodied as a plurality of third discharge parts, and wherein each of the plurality of third discharge parts comprises a third discharge outlet provided at a front end of the underground water path and configured to discharge the water stored in the second reservoir to the underground water path.

4. The dam of claim 3, wherein the second sluice gate is movably provided between the second discharge outlet and the third discharge outlet and configured to selectively open or close any one or both of the second discharge outlet and the third discharge outlet depending on a water level of the second reservoir.

5. The dam of claim 1, wherein a bottom surface of the second reservoir is provided at the same height as a bottom surface of the underground water path.

6. The dam of any one of claim 2, further comprising:

a water level sensor provided on the auxiliary dam and configured to detect a water level of the second reservoir; and a controller configured to receive a signal detected by the water level sensor and control an operation of the second drive part.

7. The dam of claim 6, wherein when the water level sensor detects the water level of the second reservoir, the controller controls the second drive part to allow the second sluice gate to close a part or the entirety of the second discharge outlet and open a part or the entirety of the third discharge outlet.

* * * * *